US006860213B2

(12) United States Patent
Shimizu

(10) Patent No.: US 6,860,213 B2
(45) Date of Patent: Mar. 1, 2005

(54) SEWING MACHINE WITH PICKER AND PICKER CONTROL PROGRAM THEREFOR

(75) Inventor: Masaki Shimizu, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/806,132

(22) Filed: Mar. 23, 2004

(65) Prior Publication Data

US 2004/0225404 A1 Nov. 11, 2004

(30) Foreign Application Priority Data

Mar. 26, 2003 (JP) ..... 2003-084206

(51) Int. Cl.[7] ..... D05B 65/00
(52) U.S. Cl. ..... 112/286; 700/136
(58) Field of Search ..... 112/225, 236, 112/242, 286

(56) References Cited

U.S. PATENT DOCUMENTS 4,401,045 A * 8/1983 Russell ..... 112/286
5,913,276 A * 6/1999 Kurono et al. ..... 112/470.01
6,352,043 B1 * 3/2002 Tajima et al. ..... 112/102.5

FOREIGN PATENT DOCUMENTS

JP A-60-210290 10/1985
JP A-9-56954 3/1997

* cited by examiner

*Primary Examiner*—Peter Nerbun
*Assistant Examiner*—Brian Kauffman
(74) *Attorney, Agent, or Firm*—Oliff & Berridge, PLC

(57) ABSTRACT

A sewing machine includes a sewing mechanism including a needle bar, a thread take-up lever and a shuttle, a picker capable of holding a needle thread extending from an eye of a sewing needle near the shuttle located below a needle plate, and a picker driver driving the picker between a first stop position where the picker is capable of holding the needle thread and a second stop position spaced farther away from the shuttle than the first position. The picker is movable to a third position spaced farther away from the shuttle than the second position.

14 Claims, 8 Drawing Sheets

SEWING MACHINE WITH PICKER AND PICKER CONTROL PROGRAM THEREFOR

BACKGROUND OF THE INVENTION

1. Field of the Invention

This invention relates to sewing machines, and more particularly to such a sewing machine provided with a picker capable of holding an upper or needle thread during severing of the needle thread and a picker control program for the sewing machine.

2. Description of the Related Art

Various types of sewing machines such as embroidery sewing machines have conventionally been provided with a picker for holding an upper or needle thread below a needle plate in order that a thread end may be prevented from appearing at an upper side of a workpiece cloth upon start of sewing or a predetermined amount of thread or more may be ensured for prevention of thread cast-off. For example, JP-A-60-210290 discloses one of such pickers. The disclosed picker is generally switchable between a needle thread holding position where the picker is in abutment with a shuttle thereby to hold the needle thread when sewing starts or when a thread is severed and a standby position where the picker is on standby while it is slightly away from the shuttle during the sewing so that the needle thread is released from the held state.

In the conventional sewing machines, however, the picker is close to the shuttle when located at the standby position. Accordingly, the picker is an encumbrance to replacement of a bobbin of the shuttle and as a result, the bobbin is difficult to replace by another. Further, the bobbin or the like interferes with the picker, whereupon there is a possibility that the picker may be broken.

SUMMARY OF THE INVENTION

Therefore, an object of the present invention is to provide a sewing machine in which the picker can be moved to another stop position which is farther away from the shuttle than the standby position close to the shuttle so that the work carried out near the shuttle, such as replacement of bobbin can be performed easily, and a picker control program for the sewing machine.

The present invention provides a sewing machine comprising a sewing mechanism including a needle bar, a thread take-up lever and a shuttle, a picker capable of holding a needle thread extending from an eye of a sewing needle near the shuttle located below a needle plate, and a picker driver driving the picker between a first stop position where the picker is capable of holding the needle thread and a second stop position spaced farther away from the shuttle than the first position, and to a third stop position spaced farther away from the shuttle than the second position.

In the above-described sewing machine, in order that a thread end may be prevented from appearing at an upper side of a workpiece cloth upon start of sewing or a predetermined amount of thread or more may be ensured for prevention of thread cast-off, the picker is driven to the first stop position by the picker driver when sewing starts or when the thread is severed immediately before completion of sewing. As a result, the needle thread extending from an eye of a sewing needle is held by the picker near the shuttle. On the other hand, during sewing, the picker is driven by the picker driver to the second position which is spaced farther away from the shuttle than the first position, so that the needle thread is released from the held state by the picker and then, sewing is carried out for the workpiece cloth by the sewing mechanism.

Further, the picker is movable to the third stop position which is spaced farther away from the shuttle than the second stop position. Consequently, the picker can be moved from the first or second stop position to the third stop position when various works carried out near the shuttle, such as, for example, bobbin replacement or removal of waste thread scattered around the shuttle, are carried out during stop of the sewing machine.

The picker may be moved from the first or second stop position to the third stop position by the picker driver. Alternatively, the picker may be moved by a driver other than the picker driver. Additionally, the operator may manually move the picker to the third stop position.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
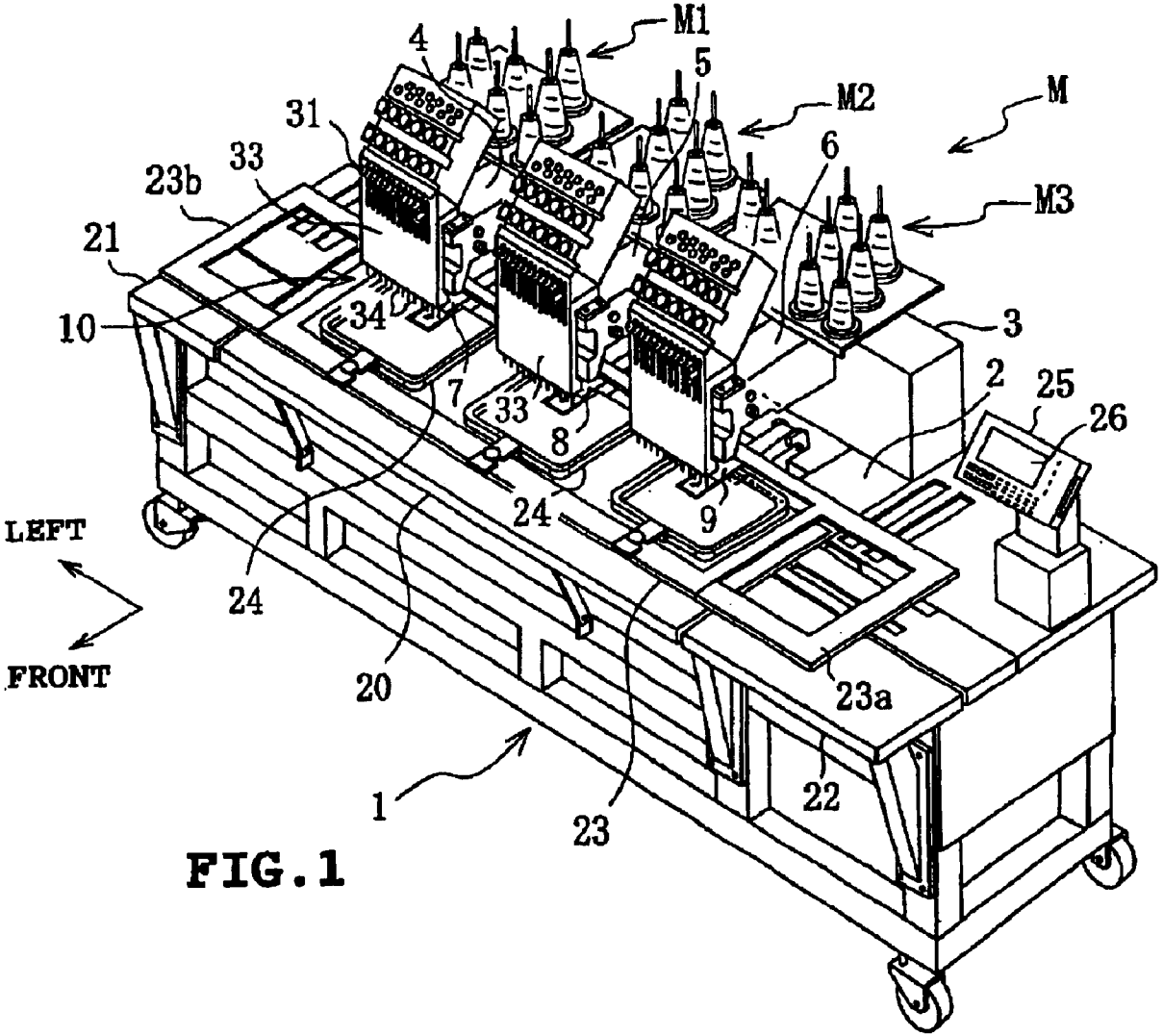
FIG. 1 is a perspective view of a multi-head sewing machine of one embodiment in accordance with the present invention.

One embodiment of the present invention will be described. The invention is applied to a multi-head sewing machine comprising three multi-needle embroidery sewing machines.

The multi-head sewing machine M will first be described. Referring to FIGS. 1 to 3C, the multi-head sewing machine M comprises abase frame 1 extending in a right-and-left direction. A sewing machine support plate 2 having a predetermined length is mounted on the rear top of the base frame 1. A support frame 3 stands on a rear end of the sewing machine support plate 2. The multi-head sewing machine M includes three multi-needle embroidery sewing machines M1 to M3 juxtaposed at predetermined intervals in the right-and-left direction.

The embroidery sewing machines M1 to M3 comprise sewing heads 4 to 6 juxtaposed at predetermined intervals in the right-and-left direction, generally cylindrical sewing beds 7 to 9, sewing mechanisms 10, thread severing mechanisms 11 (see FIG. 4), pickers 60, etc. respectively. The sewing mechanism 10 entangles a needle thread 100 and a bobbin thread 101 to form an embroidery pattern on a workpiece cloth 102. The severing mechanism 11 is constructed to sever the needle thread 100 and bobbin thread 101 below a needle plate 36 mounted on an upper front end of each bed 7 to 9. The picker 60 is constructed to hold the needle thread 100 extending from an eye 34*a* of a sewing needle 34 near a shuttle 32 located below the needle plate 36.

Figure 3A:
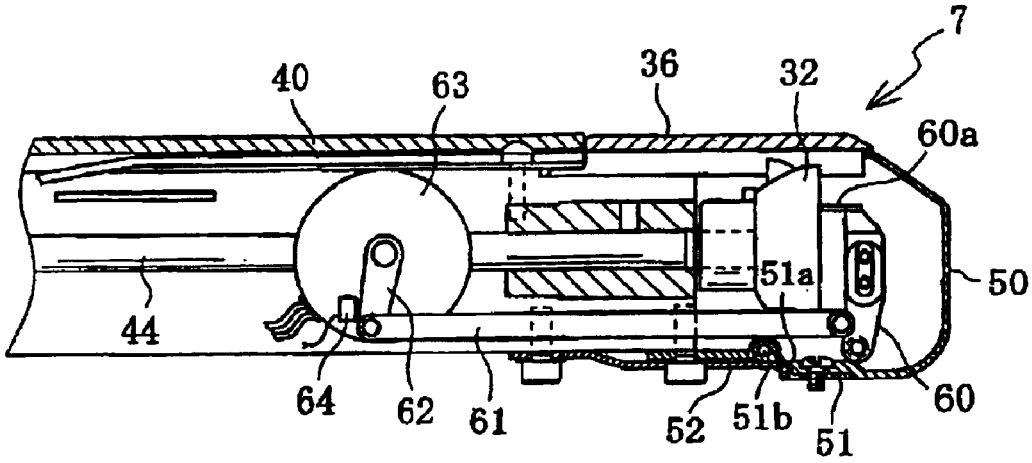
FIGS. 3A, 3B and 3C are sectional views of the sewing bed when the picker is located at the needle thread holding position, when the picker is located at the standby position, and when the picker is located at the retreat position, respectively.
Figure 3B:
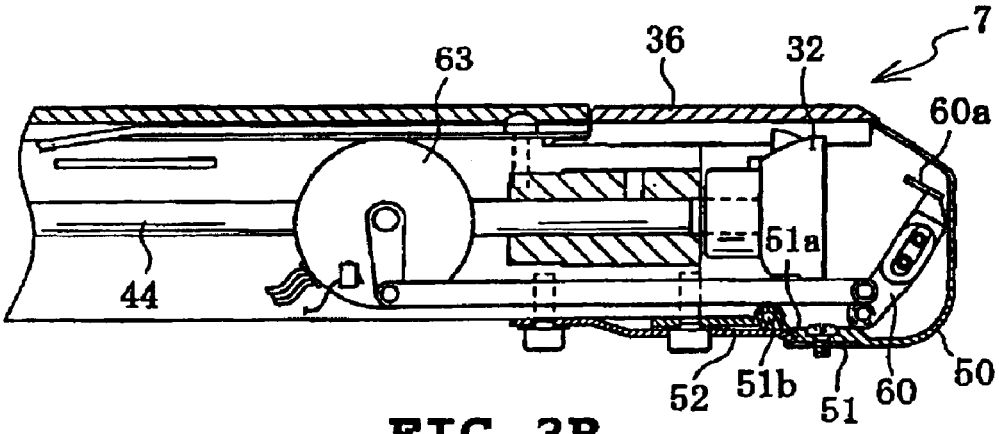
Figure 3C:
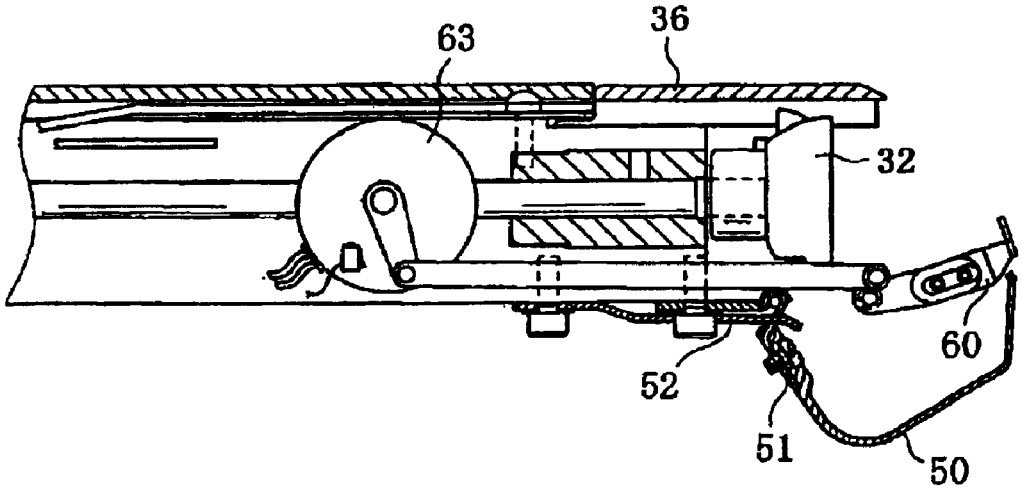

Each of the beds 7 to 9 has a rear end supported by the base frame 1 at a front end of the sewing machine support plate 2. A working table 20 is horizontally mounted so as to be located in front of the sewing machine support plate 2. A pair of auxiliary plates 21 and 22 are also mounted at right and left sides of the working table 20 respectively. Since the beds 7 to 9 have the same construction, only the bed 7 will be described. A covering member 50 is pivotally attached to the front end of the bed 7 so as to cover a front part of the shuttle 32 as shown in FIGS. 3A to 3C. A fixture 51 is coupled to a lower portion of the covering member 50 so that the covering member 50 is attached via the fixture 51 to the bed 7 so as to pivot about a pivot shaft 51*a*. A leaf spring 52 is mounted on the underside of the bed 7 and is in abutment with a notch 51*b* formed in the fixture 51. The covering member 50 and the fixture 51 are biased counterclockwise by the leaf spring 52 under the conditions as shown in FIGS. 3A and 3B.

Referring to FIGS. 3A and 3B, the sewing mechanism 10 carries out an embroidery sewing operation for the workpiece cloth 102 when a front part of the bed 7 is closed by the covering member 50 (hereinafter referred to as "a closing state" of the covering member 50), as will be described later. On the other hand, when the covering member 50 is caused to pivot clockwise in FIG. 3B against a biasing force of the leaf spring 52, the front part of the bed 7 is opened (hereinafter referred to as "an open state" of the covering member 50) as shown in FIG. 3C. When the covering member 50 is in the open state, a bobbin in the shuttle 32 can be replaced by another and other work to be done in the bed 7 can readily be carried out. The leaf spring 52 biases the covering member 50 and the fixture 51 clockwise when the covering member 50 is under the condition as shown in FIG. 3C.

A generally rectangular moving frame 23 is placed over the working table 20 and the auxiliary tables 21 and 22 so as to extend in the right-and-left direction. The moving frame 23 is provided with three cloth holding frames 24 for holding the workpiece cloth 102. A drive frame 23*a* located at a right end of the moving frame 23 is driven in the X direction or the right-and-left direction by an X-axis drive motor 88 (see FIG. 6). The drive frame 23*a* and a drive frame 23*b* located at a left end of the moving frame 23 are driven in the Y direction or the back-and-forth direction by a Y-axis drive motor 90 (see FIG. 6). Thus, the moving frame 23 is moved on an X-Y plane by the X-axis and Y-axis drive motors 88 and 90.

A cap frame to which a cap is attached can be fitted with the moving frame 23 other than the cloth holding frame 24. Furthermore, a cylindrical attaching frame (not shown) to which a cylindrical workpiece cloth such as sleeve can also be fitted with the moving frame 23. The cap frame and attaching frame are moved in the back-and-forth direction or turned a predetermined angle about the bed 7, so that an embroidery pattern can be formed on a cap or cylindrical workpiece cloth.

An operation panel 25 is mounted in the rear of the auxiliary table 22 as shown in FIG. 1. Various commands regarding the embroidery sewing operation are supplied into the operation panel 25 and include those for start and stop of sewing and bobbin replacement. The operation panel 25 is provided with various input keys such as a sewing start key, a sewing stop key, and a bobbin replacement key 25*a* (see FIG. 6) as will be described later. The operation panel 25 is also provided with a display 26 for displaying a message about the embroidery sewing operation.

Figure 2:
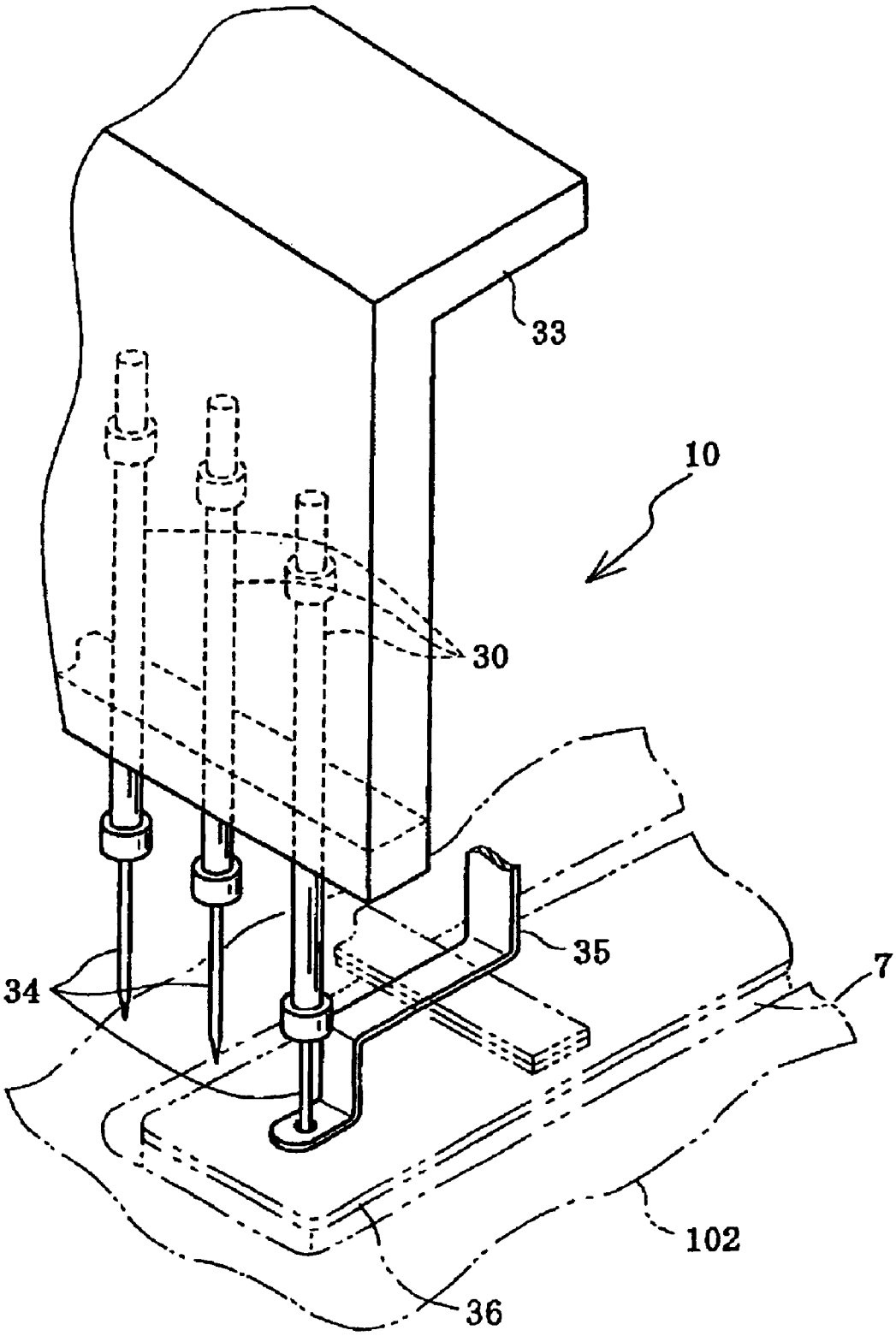
FIG. 2 is a partially enlarged perspective view of the needle bar and needle bar case.

The sewing mechanism 10 will now be described. The sewing mechanism 10 includes twelve needle bars 30, twelve thread take-up levers 31 corresponding to the respective needle bars 30 and taking up the needle thread 100 and a shuttle 32 capturing the needle thread 100 below the needle plate 36. The needle bars 30 are aligned in a row in a needle bar case 33 so as to be moved vertically as shown in FIGS. 1 and 2. Sewing needles 34 are mounted to lower ends of the needle bars 30 respectively. Each needle bar case 33 is moved in the right-and-left direction by a needle bar changing motor 86 (see FIG. 6) so that the needle threads with different colors can be changed simultaneously. A presser foot 7 is mounted on the bed 7 and is switchable vertically by a presser foot driving solenoid 76 (see FIG. 5) between a pressing position where the workpiece cloth 102 on the needle plate 36 is pressed and a retreat position located higher than the pressing position by a predetermined distance. In the needle bar case 33 are provided a needle bar vertically moving mechanism (not shown) vertically driving the needle bar 30 by a rotational driving force transmitted from a sewing machine motor 81 (see FIG. 6) to a sewing machine spindle 80 (see FIG. 6), a needle bar jumping mechanism (not shown) jumping the needle bar 30 to an uppermost position (upper dead point) and the like.

The twelve thread take-up levers 31 are supported on the needle bar case 33 so as to be vertically swingable. When the needle bar 30 is moved upward from a lower dead point after the needle 34 has been passed through the workpiece cloth, the thread take-up levers 31 is moved upward in a lag phase with upward movement of the needle bar 30 while being synchronized with rotation of the spindle 80, thereby taking the needle thread 100 up.

Referring to FIGS. 2 to 3C, an upper face of the bed 7 is covered by the needle plate 36 and a cover plate 40 continuous to the needle plate 36. The shuttle 32 is rotatably disposed below the needle plate 36 in the front interior of the cylindrical bed 7. When the needle bar 30 is moved upward from the lower dead point after needle location, the shuttle 32 captures a thread loop of the needle thread 102 formed below the needle plate 36, entangling the needle thread 100 and the bobbin thread 101.

Figure 4:
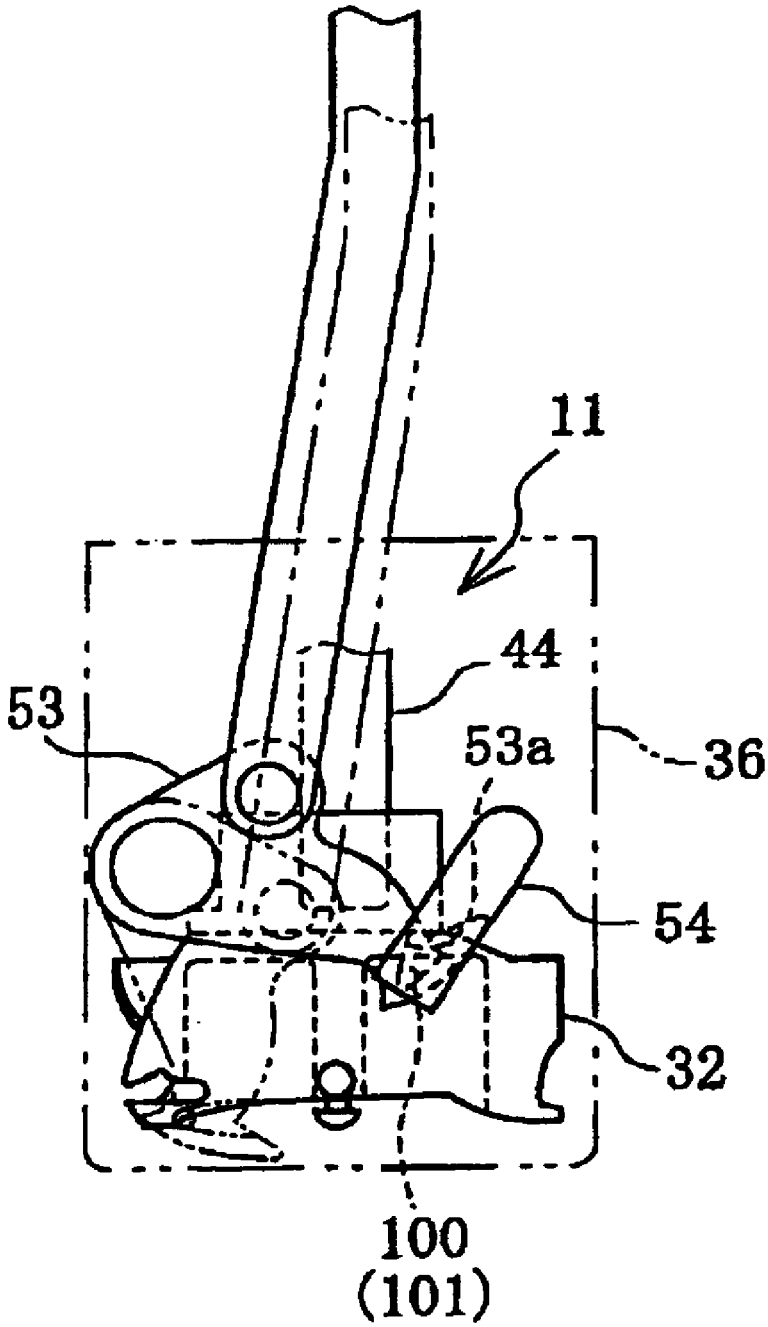
FIG. 4 is a plan view of the shuttle and a thread severing mechanism.
Figure 5:
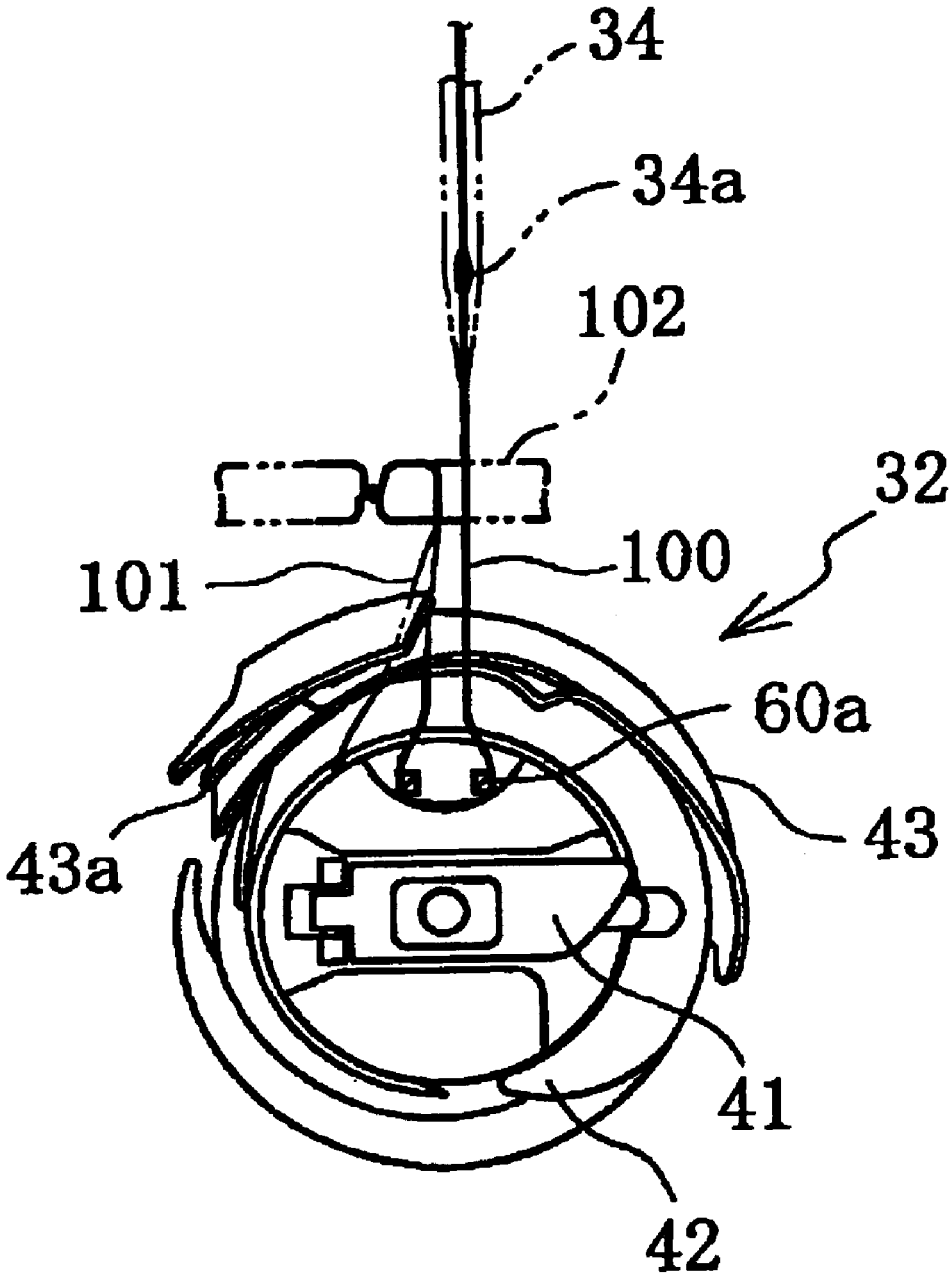
FIG. 5 is a front view of the picker and shuttle while the needle thread is held by the picker.

Referring to FIGS. 4 and 5, the shuttle 32 includes a rotating hook bobbin case holder 42 holding a bobbin case 41 in which a bobbin is housed and a rotating hook 43 rotated outside the rotating hook bobbin case holder 42. The rotating hook 43 is formed with a beak 43*a* catching the aforesaid thread loop of the needle thread 100 thereby to form a needle thread loop. A shuttle driving shaft 44 is connected to the rear end of the shuttle 32, so that the shuttle 32 is rotated by the rotational driving force of the sewing machine motor 81 with the shuttle driving shaft 44 interposed therebetween while being synchronized with the spindle 80.

The severing mechanism 11 will now be described briefly with reference to FIG. 4. A fixing plate (not shown) secured to the bed 7 extends over the shuttle 32. A movable blade 53 is pivotally mounted on the fixing plate so as to be swingable between a standby position as shown by solid line in FIG. 4 and a maximum pivoted position as shown by two-dot chain line in FIG. 4. A fixed blade 54 is mounted on the fixing plate to sever the needle thread 100 and the bobbin thread 101 in co-operation with the movable blade 53 with a blade portion being directed forward. In this case, the movable blade 54 is driven by a thread severing motor 55 (see FIG. 6) so that the needle thread 100 and the bobbin thread 101 are severed by the fixed blade 54 in co-operation with the movable blade 53.

The picker 60 will now be described. When a predetermined amount of remaining thread is ensured in the severance of the needle thread 100 by the thread severing mechanism 11, a distal end of the picker 60 is caused to abut on the bobbin in the shuttle 32 so that the needle thread 100 is caught by the distal end of the picker 60 thereby to be held for a predetermined period of time, as shown in FIGS. 3A to 3C and 5. The picker 60 is movable between a needle thread holding position (a first stop position; and see FIG. 3A) in front of the shuttle 32 in the bed 7 and a standby position (a second stop position; and see FIG. 3B) spaced slightly forwardly farther away from the shuttle 32 than the needle thread holding position. The picker 60 has a bifurcated abutment 60*a* formed on the distal end thereof. The bifurcated abutment 60*a* abuts on the shuttle 32 when the picker 60 is located at the needle thread holding position.

The picker 60 is coupled via linking members 61 and 62 to a picker driving motor 63 (a picker driver) comprising a pulse motor. The picker 60 is moved by the picker driving motor 63 between a needle thread holding position where the abutment 60*a* is in abutment with the shuttle 32 so that the picker 60 is capable of holding the needle thread 100 and a standby position where the picker 60 is on standby while being close to the shuttle 32 and having released the needle thread 100 from the held state during sewing. Further, a picker sensor 64 is provided for detecting the picker located at the needle thread holding position. On the other hand, every time when moved from the needle thread holding position to the standby position, the picker 60 collides against the covering member 50 such that noise due to the collision is produced. However, such noise can be prevented when the bed 7 is constructed so that a predetermined space is defined between the picker 60 and the covering member 50 while the picker 60 is located at the standby position.

When the bobbin is replaced by another during stop of the sewing machine, the operator manually causes the covering member 50 to pivot and carries out the replacement while the covering member 50 remains open. In this case, as shown in FIG. 3B, when remaining at the standby position close to the shuttle 32, the picker 60 is an encumbrance to replacement of the bobbin of the shuttle and as a result, the bobbin is difficult to replace by another. Thus, the picker 60 remaining at the standby position constitutes a hindrance to the bobbin replacement. In view of this problem, as shown in FIG. 3C, the picker 60 can be moved by the picker driving motor 63 to a retreat position (a third stop position) which is spaced farther away from the shuttle 32 than the standby position.

The picker 60 partially protrudes forward from the front end of the bed 7 when remaining at the retreat position. Conversely speaking, when located at the standby position which is a normal position during sewing, the picker 60 is located near the shuttle 32 although slightly spaced from the shuttle 32. In this case, the picker 60 is not protruded forward from the bed 7 as it is located at the retreat position. Accordingly, the picker 60 can be moved quickly from the standby position to the needle thread holding position when the needle thread 100 needs to be held by the picker 60.

Furthermore, the picker 60 is not protruded forward when located at the standby position. Accordingly, particularly where a cylindrical or annular workpiece cloth 102 with a closed front end such as a cap is sewn, the workpiece cloth 102 is moved rearward relative to the bed 7. In this case, a sewable range of the workpiece cloth 102 can be increased with respect to the back-and-forth direction. A control manner in the movement of the picker to the retreat position will be described with a picker control program later.

Figure 6:
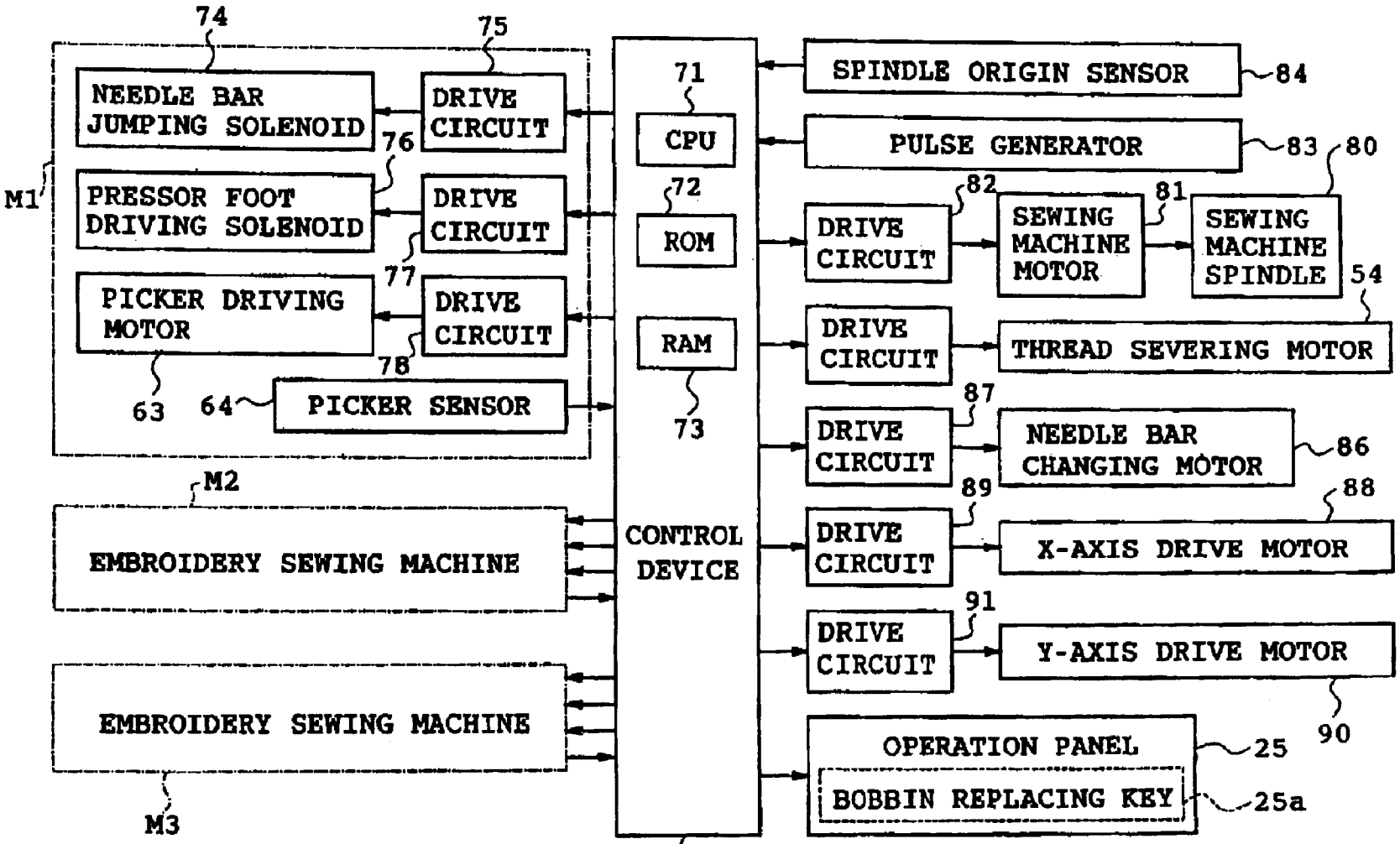
FIG. 6 is a block diagram showing the control system of the multi-head sewing machine.

The control system of the multi-head sewing machine M will be described with reference to a block diagram of FIG. 6. A control device 70 constituting the control system of the multi-head sewing machine M comprises a microcomputer including CPU 71, ROM 72 and RAM 73 and an input-output interface (not shown) connected via a bus to the microcomputer. To the control device 70 are connected a drive circuit 75 for a needle bar jumping solenoid 74 of the needle bar jumping mechanism, a drive circuit 77 for a presser foot driving solenoid 76, a drive circuit 78 for the picker driving motor 63, the picker sensor 64 and the like. Furthermore, to the control device 70 are connected a drive circuit 82 driving the sewing machine motor 81 rotating the spindle 80, a pulse generator 83 generating an encoder signal including 1000 pulse signals per turn of a disc encoder provided on the spindle 80, a spindle origin sensor 84 generating one spindle synchronization signal per turn of the disc encoder, a drive circuit 85 for the thread severing motor 55, a drive circuit 87 for the needle bar changing motor 86, a drive circuit 89 for the X-axis drive motor 88, a drive circuit 91 for the Y-axis drive motor 90, and the operation panel 25.

ROM 72 stores a program relating to the embroidery sewing of the overall multi-head sewing machine M and a plurality of sewing data. ROM 72 further stores a picker control program on which the picker 60 is moved between the needle thread holding position and the standby position when a predetermined amount of remaining thread is ensured in severing the needle thread 100 by the thread severing mechanism 11 and the picker 60 is moved between the standby position and the retreat position when a bobbin is replaced by another during stop of sewing.

During sewing, the picker control program is carried out at the time of start of sewing or before the thread severing operation by the thread severing mechanism 11, so that the picker 60 is moved from the standby position to the needle thread holding position to hold the needle thread 100 temporarily. After the spindle 80 is rotated a predetermined angle, the picker 60 is returned from the needle thread holding position to the standby position thereby to release the needle thread 100. This operation is generally carried out by conventional sewing machines provided with the respective pickers 60. Accordingly, further description is eliminated.

On the other hand, the picker control program includes a picker retreating process which is peculiar to the present invention. In the picker retreating process, the picker 60 is retreated from the standby position to the retreat position when the bobbin replacing key 25*a* is operated for the purpose of replacement of a bobbin by another and a signal commanding the movement of the picker 60 from the standby position to the retreat position is supplied to the control device 70.

The picker retreating process will be described with reference to the flowchart of FIG. 7. Reference symbols S1, S2, and the like in FIG. 7 designate processing step numbers respectively. In the picker retreating process, firstly, the operator operates the bobbin replacing key 25*a* so that a signal commanding retreat of the picker 60 from the standby position to the retreat position is supplied to the control device 70 (YES at step S10). When the sewing operation is under execution (YES at step S1), the control device 70 returns to a previous processing so that the picker 60 is prevented from retreating to the retreat position during the sewing operation thereby to protrude forward from the bed 7. Thus, the movement of the picker 60 to the retreat position is prevented in order that the picker 60 may be prevented from interfering with the front end of the workpiece cloth 102 when an embroidery pattern is formed on the workpiece cloth 102 with a closed front end side, such as a cap.

On the other hand, the picker 60 is driven from the standby position to the retreat position by the picker driving motor 63 (step S12) when the sewing operation is not under execution (NO at step S11). Under these conditions, the picker 60 is driven from the retreat position to the standby position by the picker driving motor 63 (step S14) when the bobbin is replaced by another by the operator and thereafter the bobbin replacing key 25*a* is re-operated so that the signal commanding return of the picker 60 from the retreat position to the standby position is supplied to the control device 70 (YES at step S13). The operator manually opens the covering member 50 before operating the bobbin replacing key 25*a*.

Figure 7:
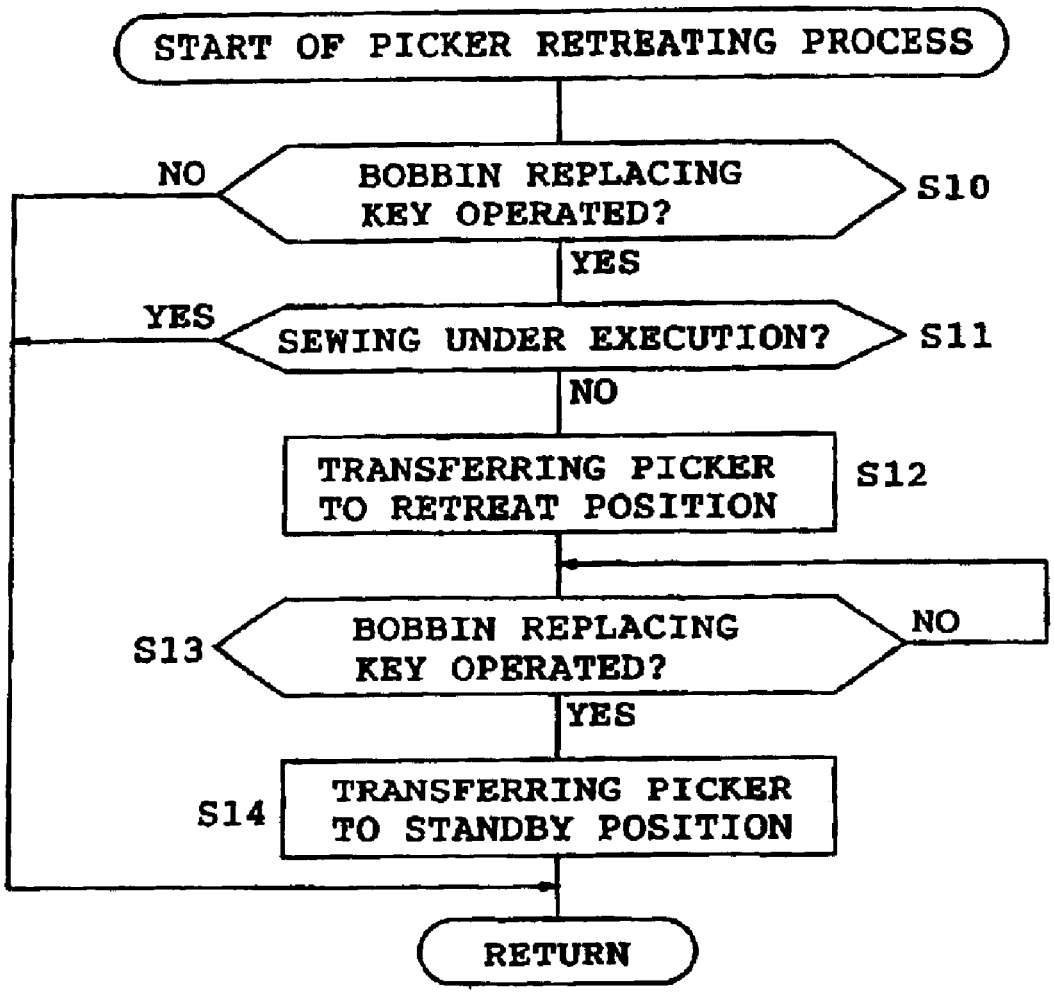
FIG. 7 is a flowchart showing a picker retreating process.

In the above-described arrangement, the flowchart of FIG. 7 serves as a picker retreating routine. The microcomputer of the control device 70 and the flowchart of FIG. 7 serve as a picker control. Step S11 in the flowchart of FIG. 7 and the microcomputer of the control device 70 serve as a moving check.

The following effects are achieved from the foregoing multi-head sewing machine M. The picker 60 can be moved to the retreat position (see FIG. 3C) which is spaced farther away from the shuttle 32 than the standby position. Accordingly, the picker 60 can be moved from the standby position to the retreat position when the bobbin of the shuttle 32 is replaced by another. Consequently, the bobbin can be replaced by another easily.

The picker 60 is close to the shuttle 32 when located at the standby position. Accordingly, the needle thread 100 is held quickly by the picker 60 since the movement distance of the picker 60 is reduced when the picker 60 is moved to the needle thread holding position to hold the needle thread 100. Consequently, the needle thread 100 can reliably be held by the picker 60 with suitable timing.

The picker 60 is housed in the bed 7 when located at the standby position. A part of the picker 60 protrudes forward for the first time when having been moved to the retreat position. Accordingly, the length of the bed 7 is determined to be sufficient when the picker 60 is housed therein. Consequently, the dimension of the bed 7 from the shuttle 32 to the distal end thereof can be reduced. Particularly when a cylindrical or annular workpiece cloth 102 with a closed front end such as a cap is sewn, the workpiece cloth 102 is moved in the back-and-forth direction relative to the bed 7. In this case, a sewable range of the workpiece cloth 102 can be increased with respect to the back-and-forth direction without the picker 60 located at the standby position interfering with the closed front end of the workpiece cloth 102.

The picker 60 is prevented from moving to the retreat position when the bobbin replacing key 25*a* is operated in the picker retreating process as shown in FIG. 7 during sewing. Consequently, for example, the picker 60 can reliably be prevented from interfering with the front end of the workpiece cloth 102 during sewing when a workpiece cloth 102 with a closed front end such as a cap is sewn.

Modified forms of the foregoing embodiment will now be described. Identical or similar parts are labeled by the same reference symbols as those in the foregoing embodiment and description of these parts will be eliminated.

Firstly, the movement of the picker 60 to the retreat position is not limited to the replacement of the bobbin. The movement of the picker 60 to the retreat position can be applied to another case where various works carried out near the shuttle, such as, for example, removal of waste thread scattered in the bed 7 or maintenance of the shuttle 32.

In the foregoing embodiment, the picker 60 is not moved to the retreat position when sewing is under execution as shown by step S11 in FIG. 7. However, a sensor may be provided for detecting an open or closed state of the covering member 50, instead. In this case, the picker 60 maybe prevented from moving from the standby position to the retreat position when the covering member 50 is closed.

On the other hand, the picker 60 may be driven to the retreat position while the covering member 50 remains closed. In this case, the covering member 50 is opened via the picker 60 by the driving force of the picker driving motor 63, so that the covering member 50 is opened concurrently with movement of the picker 60 to the retreat position. Furthermore, the picker 60 may be driven between the standby position and the retreat position by a driver other than the picker driving motor 63. Moreover, the operator may manually move the picker 60 to the retreat position. Furthermore, although the covering member 50 is manually closed and opened in the foregoing embodiment, the covering member 50 may be closed and opened by an actuator such as a pulse motor, instead.

A known sensor may be provided for detecting severance of the bobbin thread or insufficiency in remaining amount of bobbin thread. In this case, the picker 60 may be moved to the retreat position when the sensor has detected severance of the bobbin thread or insufficiency in remaining amount of bobbin thread. Consequently, since the covering member 50 need not be opened and the bobbin replacing key 25*a* need not be operated for the replacement of the bobbin, the working efficiency can be improved.

The picker 60 is located at the standby position during stop of sewing in the foregoing embodiment. The picker 60 is moved from the standby position to the retreat position at the time of bobbin replacement. The stop position of the picker 60 during stop of sewing may be the needle thread holding position and may be moved from the needle thread holding position to the retreat position.

Figure 8A:
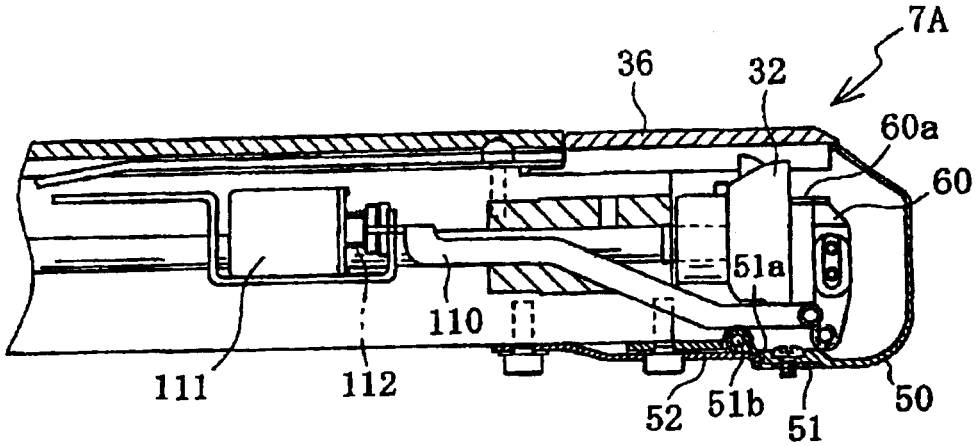
FIGS. 8A, 8B and 8C are views similar to FIGS. 3A to 3C, showing a modified form.
Figure 8B:
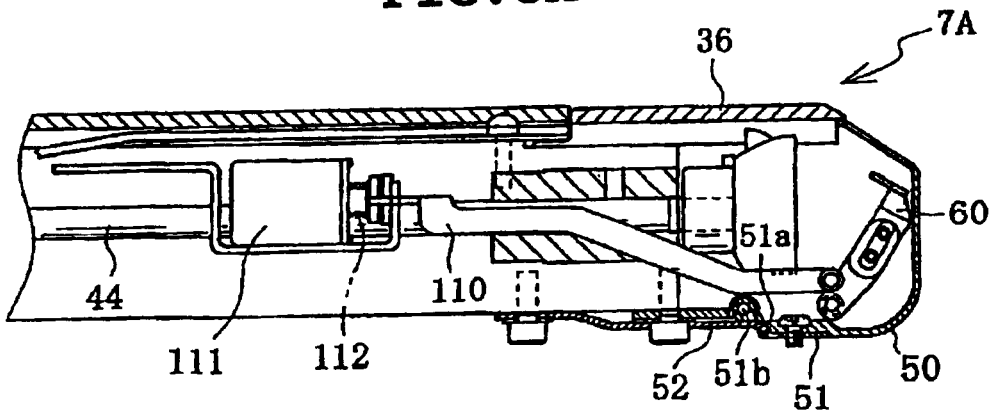
Figure 8C:
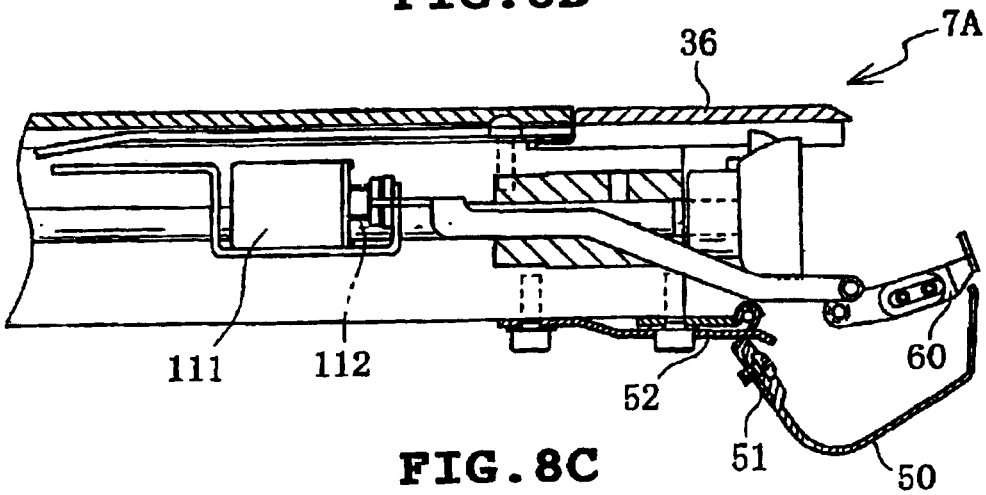

The covering member 50 pivotally mounted on the bed 7A may on the picker 60 in its closing state, thereby preventing moving to the retreat position, as shown in FIG. 8. In the open state, the covering member 50 may allow the picker 60 to move to the retreat position. In this modified form, the picker 60 is provided in the bed 7 and can be moved to three positions, that is, the needle thread holding position (see FIG. 8A), the standby position (see FIG. 8B) and the retreat position (see FIG. 8C). A linking member 110 has a front end coupled to the lower end of the picker 60. The picker 60 is coupled via the linking member 110 to a picker driving solenoid 111 which is capable of driving the picker 60 to the needle thread holding position.

In the above-described construction, when the picker driving solenoid 111 is turned on, the linking member 110 is driven rearward against the biasing force of a spring 112, so that the picker 60 is rotated counterclockwise as viewed in FIG. 8 A thereby to be moved to the needle thread holding position. On the other hand, as shown in FIG. 8B, when the picker driving solenoid 111 is in the OFF state with the covering member 50 in the closing state, the picker 60 is biased clockwise (the direction in which the picker 60 abuts on the covering member 50 ) by the spring 112 as viewed in FIG. 8B since the linking member 110 is biased frontward by the spring 112. In this state, however, the picker 60 abuts on an inside portion of the covering member 50 thereby to stop at the standby position and concurrently, the picker 60 is prevented from moving to the retreat position.

Furthermore, when the operator rotates the covering member 50 clockwise in the state as shown in FIG. 8B to open the covering member 50, the covering member 50 is parted from the picker 60, whereupon the picker 60 is allowed to move to the retreat position. As a result, the picker 60 is rotated clockwise to move to the retreat position as viewed in FIG. 8C. Accordingly, the covering member 50 serves as a moving check in this modified form.

In the foregoing modified form, substantially the same effect can be achieved as that achieved by the foregoing embodiment. Additionally, the picker 60 can be prevented from moving to the retreat position and allowed to move to the retreat position by a simple construction comprising the picker driving solenoid 111, spring 112 and covering member 50. Further, no actuator is required for driving the picker 60 to the retreat position.

An actuator such as an air cylinder may be provided for driving the picker 60 to the needle thread holding position, other than the picker driving solenoid 111.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A sewing machine comprising:

a sewing mechanism including a needle bar, a thread take-up lever and a shuttle;

a picker capable of holding a needle thread extending from an eye of a sewing needle near the shuttle located below a needle plate; and a picker driver driving the picker between a first stop position where the picker is capable of holding the needle thread, a second stop position spaced farther away from the shuttle than the first position, and a third position spaced farther away from the shuttle than the second position.

2. A sewing machine according to claim 1, wherein the third stop position corresponds to a stop position of the picker in a case of replacement of a bobbin in the shuttle by another.

3. A sewing machine according to claim 1, wherein the second stop position corresponds to a position where the picker is on standby while coming close to the shuttle and having released the needle thread during sewing.

4. A sewing machine according to claim 1, wherein the second stop position corresponds to a position where the picker is on standby while coming close to the shuttle and having released the needle thread during sewing.

5. A sewing machine according to claim 1, further comprising a cylindrical sewing bed in which the shuttle is housed, wherein the picker is disposed in the sewing bed so as to be nearer to a distal end of the bed than the shuttle, and the picker partially protrudes outward from the distal end of the bed when at the third stop position.

6. A sewing machine according to claim 1, further comprising a moving check preventing the picker from moving from the first or second stop position to the third stop position.

7. A sewing machine according to claim 6, further comprising an input device supplying a command signal for commanding movement of the picker from the first or second stop position to the third stop position, wherein the moving check prevents the picker from movement to the third stop position when the input device has supplied the command signal during sewing.

8. A sewing machine according to claim 6, further comprising a sewing bed in which the shuttle is housed, wherein the moving check includes a covering member attached to the bed so that the covering member is closed and opened, the covering member in a closed state abuts on the picker thereby to prevent the picker from moving to the third stop position, and the covering member in an open state allows the picker to move to the third stop position.

9. A sewing machine according to claim 8, wherein the picker driver includes an actuator capable of driving the picker to the first stop position and a biasing unit biasing the picker in such a direction that the picker abuts on the covering member, and a biasing force of the biasing unit moves the picker to the third stop position when the covering member is open.

10. A sewing machine according to claim 8, wherein the picker driver includes an actuator capable of driving the picker to the first and second stop positions, a biasing unit biasing the picker in such a direction that the picker abuts on the covering member, and a biasing force of the biasing unit moves the picker to the third stop position when the covering member is open.

11. A sewing machine according to claim 1, wherein the picker driver includes a pulse motor capable of driving the picker to the first, second and third positions.

12. A sewing machine according to claim 11, further comprising a sewing bed in which the shuttle is housed and a covering member attached to the bed so that the covering member is closed and opened, wherein the covering member is opened when the picker driver moves the picker from the second stop position to the third stop position.

13. A sewing machine comprising:

a sewing mechanism including a needle bar, a thread take-up lever and a shuttle;

a picker capable of holding a needle thread extending from an eye of a sewing needle near the shuttle located below a needle plate;

a picker driver driving the picker between a first stop position where the picker is capable of holding the needle thread and a second stop position spaced farther away from the shuttle than the first position, the picker being movable to a third position spaced farther away from the shuttle than the second stop position;

a moving check preventing the picker from moving from the first or second stop position to the third stop position, the moving check including a covering member attached to the bed so that the covering member is closed and opened, the covering member in a closed state abutting on the picker thereby to prevent the picker from moving to the third stop position, the covering member in an open state allowing the picker to move to the third stop position, wherein the picker driver includes an actuator capable of driving the picker to the first and second stop positions and a biasing unit biasing the picker in such a direction that the picker abuts on the covering member, and a biasing force of the biasing unit moves the picker to the third stop position when the covering member is open.

14. A picker control program for use in a sewing machine including a sewing mechanism including a needle bar, a thread take-up lever and a shuttle, a picker capable of holding a needle thread extending from an eye of a sewing needle near the shuttle located below a needle plate, a picker driver driving the picker between a first stop position where the picker is capable of holding the needle thread and a second stop position spaced farther away from the shuttle than the first position, the picker being movable further to a third position spaced farther away from the shuttle than the second position, an input device supplied with a command signal for commanding movement of the picker from the first or second stop position to the third stop position, and a picker control device controlling the picker driver based on the command signal and including a computer executing the program, the program comprising a picker retreating routine in which the picker is retreated from the first or second stop position to the third stop position when the input device is supplied with the command signal.

* * * * *